US008608300B2

(12) United States Patent
Igawa et al.

(10) Patent No.: US 8,608,300 B2
(45) Date of Patent: Dec. 17, 2013

(54) LIQUID CIRCULATION SYSTEM AND INK-JET PRINTER

(75) Inventors: Tomomi Igawa, Nagano (JP); Seiichi Yokoyama, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 13/500,639

(22) PCT Filed: Oct. 13, 2010

(86) PCT No.: PCT/JP2010/067976

§ 371 (c)(1), (2), (4) Date: Apr. 5, 2012

(87) PCT Pub. No.: WO2011/046151

PCT Pub. Date: Apr. 21, 2011

(65) Prior Publication Data

US 2012/0200649 A1 Aug. 9, 2012

(30) Foreign Application Priority Data

Oct. 13, 2009 (JP) ..... 2009-236299

(51) Int. Cl.
*B41J 2/18* (2006.01)

(52) U.S. Cl.
USPC ..... 347/89

(58) Field of Classification Search
USPC ..... 347/89
See application file for complete search history.

(56) References Cited

U.S. PATENT DOCUMENTS 6,679,597 B2 * 1/2004 Ohsawa et al. ..... 347/95
7,182,444 B2 * 2/2007 Kawamoto ..... 347/85

FOREIGN PATENT DOCUMENTS

| | | |
|---|---|---|
| JP | 10-138515 | 5/1998 |
| JP | 2003-072104 | 3/2003 |
| JP | 2005-067122 | 3/2005 |
| JP | 2009-018587 | 1/2009 |

* cited by examiner

*Primary Examiner* — Matthew Luu
*Assistant Examiner* — Michael Konczal
(74) *Attorney, Agent, or Firm* — Jianq Chyun IP Office

(57) ABSTRACT

An ink circulation system includes: an ink-jet head in which a shared ink flowing route is formed, an ink tank, a supply flowing route for supplying ink from the ink tank to the shared ink flowing route, a reflux flowing route for refluxing the ink from the shared ink flowing route to the ink tank, and a differential pressure generating unit for generating a differential pressure in the ink tank. The differential pressure generating unit is equipped with an impeller placed inside the ink tank, and a drive unit placed outside the ink tank. Then, the drive unit operates to turn the impeller, by means of remote driving, for generating a differential pressure between a supply port of the supply flowing route and a reflux port of the reflux flowing route so as to circulate the ink through the ink flowing route.

2 Claims, 7 Drawing Sheets

LIQUID CIRCULATION SYSTEM AND INK-JET PRINTER

CROSS-REFERENCE TO RELATED APPLICATION

This application is a 371 of international application of PCT application serial no. PCT/JP2010/067976, filed on Oct. 13, 2010, which claims the priority benefit of Japan application no. 2009-236299, filed on Oct. 13, 2009. The entirety of each of the above-mentioned patent applications is hereby incorporated by reference herein and made a part of this specification.

FIELD OF THE INVENTION

The present invention relates to a liquid circulation system to be mounted in a liquid discharging machine such as an ink-jet printer, from which liquid is discharged, and an ink-jet printer.

BACKGROUND

Conventionally, known as a liquid discharging machine discharging liquid are an ink-jet printer that discharges ink, an industrial-use liquid coating machine that discharges high-viscosity liquid such as edible oil, adhesive, and so on, and the like. Such a liquid discharging machine includes a liquid discharging head for discharging liquid and a liquid container that supplies the liquid to the liquid discharging head. Then, while the liquid being supplied from the liquid container to the liquid discharging head, the liquid is discharged from the liquid discharging head.

In the meantime, used in an ink-jet printer is ink containing fine particles of pigment and the like, such as metallic ink, pearl ink, white ink, and so on. Having a great specific gravity than a solvent, the fine particles contained in the ink are materialized with metals, ores, and the like. Therefore, when the ink is left still, the fine particles become precipitated and deposited. Then, needed accordingly is a means for diffusing the fine particles.

In the case of Patent Document 1 and Patent Document 2, a supply route for supplying ink from a ink tank to an ink-jet head is provided with a circulation channel connecting the supply route and the ink tank as well as a pump placed in the circulation channel; then operation of the pump controls precipitation and deposition of fine particles in the supply route. Furthermore in the case of Patent Document 1 and Patent Document 2, a rotor is placed in the ink tank in such a way that rotation of the rotor stirs the ink stored in the ink tank to control precipitation and deposition of the fine particles.

PRIOR ART DOCUMENTS

Patent Documents

[Patent Document 1] Japanese Unexamined Patent Application Publication No. 2009-018587

[Patent Document 2] Japanese Unexamined Patent Application Publication No. 2003-072104

SUMMARY OF INVENTION

Problems to Be Solved

Unfortunately, the technology described in Patent Document 1 and Patent Document 2 requires that the pump should additionally be installed in the circulation channel connecting the ink tank and the ink-jet head so that the configuration becomes complicated. Moreover, since the circulation of the ink does not reach the ink-jet head, the fine particles in the ink flowing route cannot appropriately be diffused.

Furthermore, in an industrial-use liquid coating machine, used is high-viscosity liquid such as edible oil, adhesive, and so on. Such high-viscosity liquid causes an uneven amount of drop liquid or clogged discharge of drop liquid due to flowing route resistance. Therefore, if the liquid movement once stops, a certain time span is needed before re-movement. Therefore, unfortunately it takes some time to shift into actual operating condition (in which the temperature and circulation of the liquid become homogeneous) after starting operation of the industrial-use liquid coating machine.

It is an object of the present invention to provide a liquid circulation system and an ink-jet printer that control liquid stagnation in a flowing route, and enable appropriate circulation of the liquid.

Means to Solve the Problems

A liquid circulation system according to the present invention is a liquid circulation system to be installed in a liquid discharging machine for discharging liquid, including: a liquid discharge head having a plurality of nozzles for discharging liquid and a shared flowing route connected to the nozzles; a liquid container for storing the liquid to be supplied to the liquid discharge head; a first flowing route for supplying the liquid from the liquid container to one end of the shared flowing route; a second flowing route for refluxing the liquid from the other end of the shared flowing route to the liquid container; and a differential pressure generating section for generating a differential pressure between a supply port, through which the liquid is supplied from the liquid container to the first flowing route, and a reflux port, through which the liquid is refluxed from the second flowing route to the liquid container, in the liquid stored in the liquid container.

According to the liquid circulation system of the present invention, the liquid is supplied to one end of the shared flowing route in the liquid discharge head from the liquid container by way of the first flowing route, and meanwhile the liquid is refluxed to the liquid container from the other end of the shared flowing route by way of the second flowing route. Thus, the liquid supplied from the liquid container to the liquid discharge head is able to circulate through the liquid flowing route by way of the liquid container, the first flowing route, the shared flowing route, and the second flowing route. Then, generating the differential pressure between the supply port, through which the liquid is supplied from the liquid container to the first flowing route, and the reflux port, through which the liquid is refluxed from the second flowing route to the liquid container, by using the differential pressure generating section makes it possible to circulate the liquid through the liquid flowing route by way of the liquid container, the first flowing route, the shared flowing route, and the second flowing route. Thus, even when liquid containing fine particles is used, the fine particles can be dispersed by means of generating the differential pressure in the liquid container with the differential pressure generating section, and therefore it becomes possible to control precipitation and deposition of the fine particles without adopting any complicated framework, such as installing an extra pump separately, and so on. Furthermore, even when high-viscosity liquid is used, the liquid is able to keep on moving without interruption. Moreover, circulating the liquid through the shared flowing route as well makes it possible to control precipitation and deposition of the fine particles in the shared flowing route; and therefore simply exhausting only the liquid that dwells in each of the nozzles of the liquid discharging head makes it possible to control unevenness of the fine particles in the liquid flowing route, at the time of operating the liquid discharging machine, for example. As a result, the amount of liquid exhausted wastefully by way of flashing can be cut back so that running costs of the liquid discharging machine can significantly be reduced.

In this case, it is preferable that the differential pressure generating section includes; a rotor placed in the liquid container; and a rotary driving section for turning the rotor. As described above, with the rotor being placed in the liquid container, differential pressures can be generated between a center area and the vicinity of an internal wall in the liquid container, and also between an upper area and a lower area in the liquid container, by means of turning the rotor with the rotary driving section. Therefore, for example, with the supply port, through which the liquid is supplied from the liquid container to the first flowing route, being placed in the vicinity of the internal wall or the lower area of the liquid container, and the reflux port, through which the liquid is refluxed from the second flowing route to the liquid container, being placed in the center area or the upper area of the liquid container, a differential pressure can easily be generated between the supply port and the reflux port. Moreover, as the rotor turns in the liquid container, the liquid stored in the liquid container is also agitated so that the fine particles can be dispersed more appropriately.

In an ink-jet printer according to the present invention, either of the liquid circulation systems described above is installed.

According to the ink-jet printer of the present invention, when the liquid circulation system described above is installed, a differential pressure is generated in an ink tank as the liquid container. Therefore, even when ink containing fine particles is used, the fine particles can be dispersed, and accordingly it becomes possible to control precipitation and deposition of the fine particles without adopting any complicated framework, such as installing an extra pump separately, and so on. Moreover, circulating the ink through the shared flowing route as well makes it possible to control precipitation and deposition of the fine particles in the shared flowing route; and therefore simply exhausting only the ink that dwells in each of the nozzles of the liquid discharging head makes it possible to control unevenness of the fine particles in the ink flowing route, at the time of operating the ink-jet printer. As a result, the amount of ink exhausted wastefully by way of flashing can be cut back so that running costs of the ink-jet printer can significantly be reduced.

Advantageous Effect of the Invention

According to the present invention, it becomes possible to control liquid stagnation in a flowing route, and enable appropriate circulation of the liquid.

BRIEF DESCRIPTION OF THE DRAWINGS

FIG. 4A shows an impeller equipped with flat-plate blades, while FIG. 4B shows an impeller equipped with curved blades.

FIG. 5A shows a top view of the ink tank, while FIG. 5B shows a front elevation view of the ink tank.

DESCRIPTION OF THE PREFERRED EMBODIMENT

Figure 1:
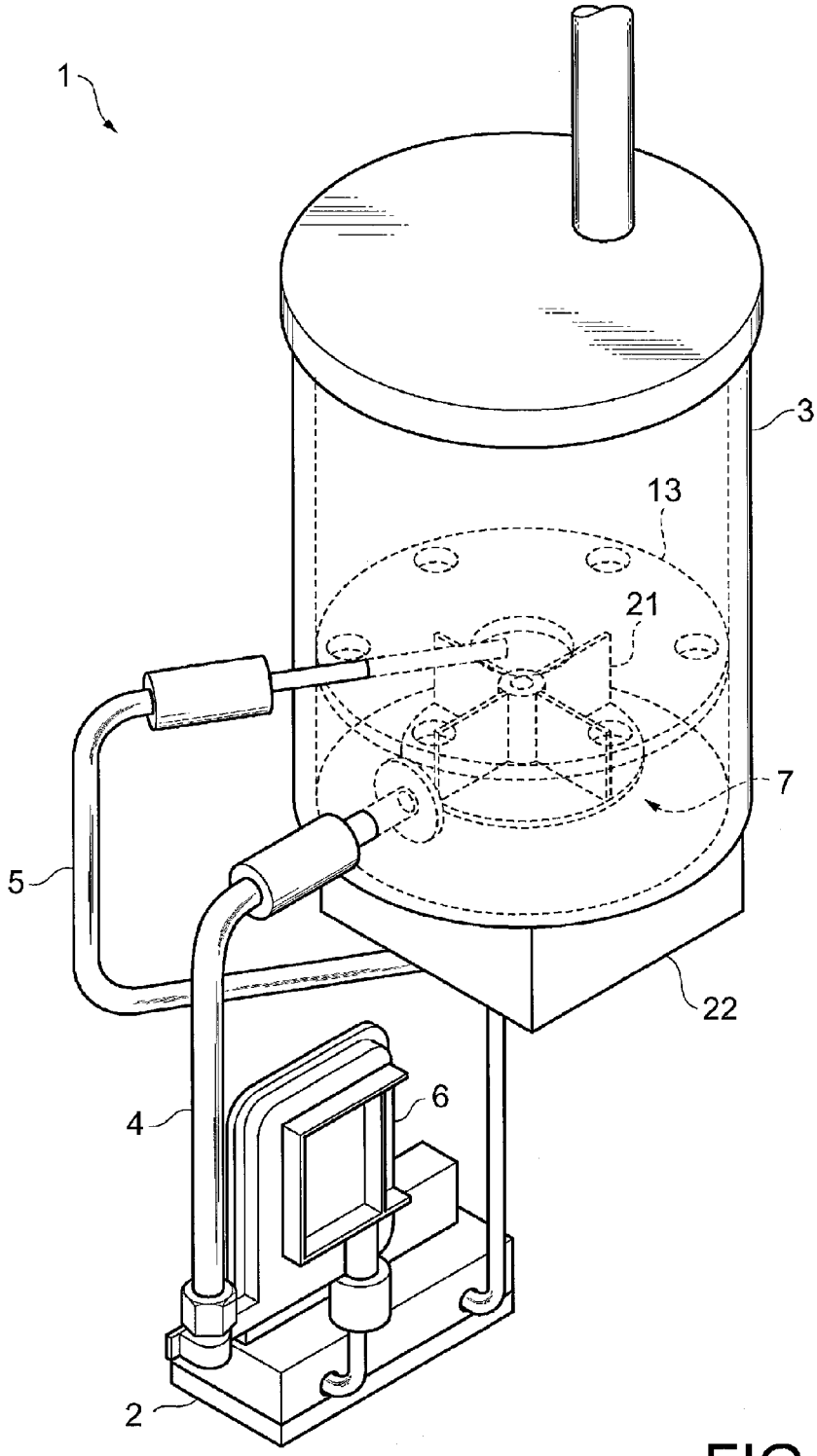
FIG. 1 is a perspective view of an ink circulation system according to an embodiment.

A preferred embodiment of a liquid circulation system according to the present invention is described below in detail with reference to the accompanying drawings. In the present embodiment, the liquid circulation system according to the present invention is applied to an ink circulation system mounted in an ink-jet printer that is a liquid discharging machine. In the explanation below, the same or equivalent portion is provided with the same reference numeral.

The ink circulation system according to the present embodiment is mounted in the ink-jet printer, and it circulates ink through an ink flowing route of the ink-jet printer. As the ink to be circulated in the ink circulation system, used is metallic ink, pearl ink, white ink, and so on that contains fine particles of pigment and the like in a solvent.

Figure 2:
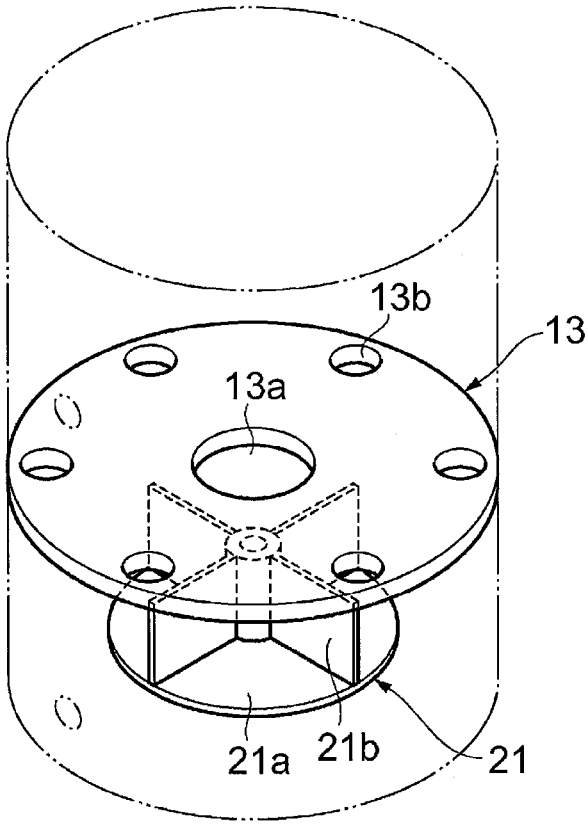
FIG. 2 is a perspective drawing of an ink tank shown in FIG. 1.
Figure 3:
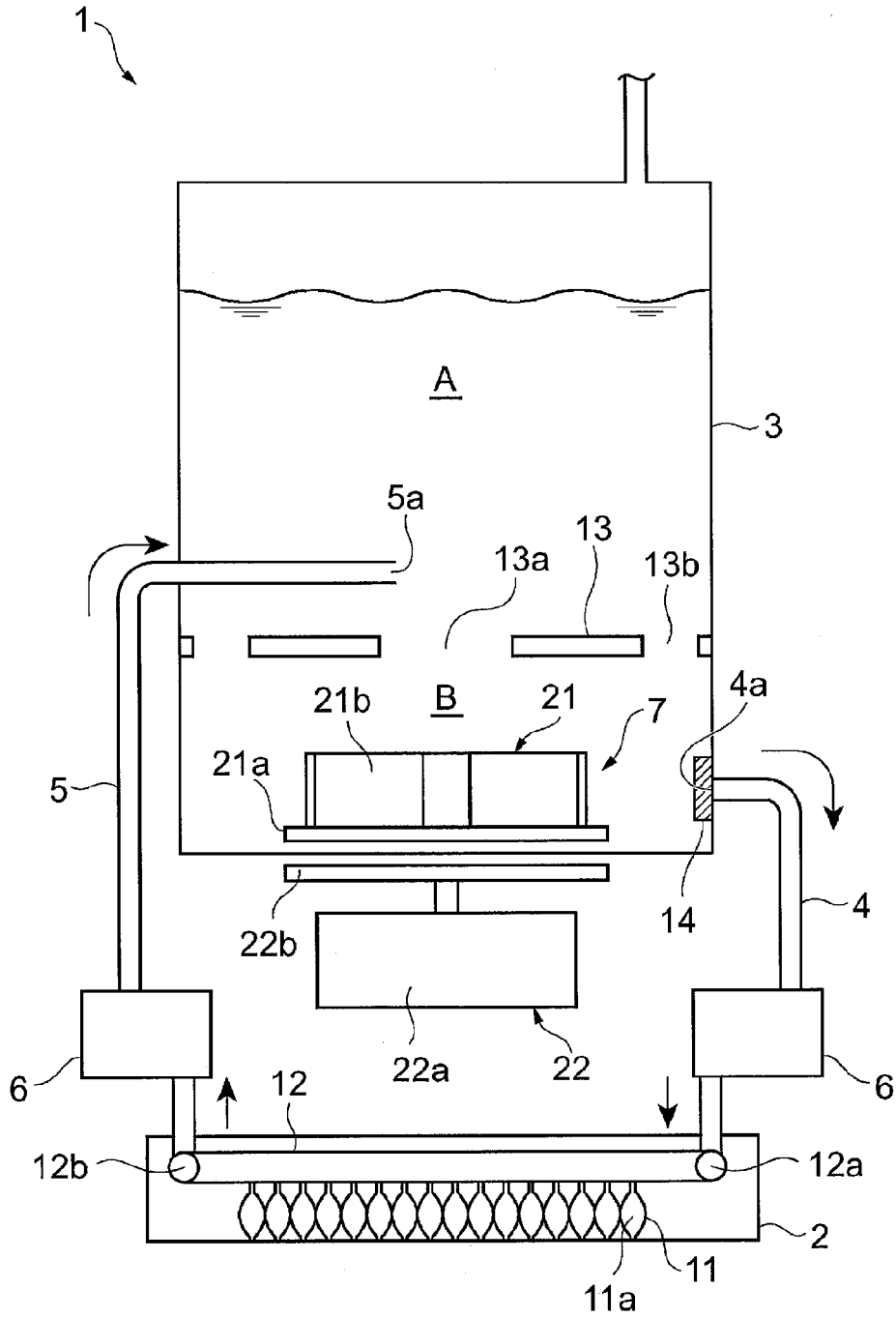
FIG. 3 is a schematic diagram showing a circulation channel of the ink circulation system.

FIG. 1 is a perspective view of the ink circulation system according to the embodiment, and FIG. 2 is a perspective drawing of an ink tank shown in FIG. 1, meanwhile FIG. 3 is a schematic diagram showing a circulation channel of the ink circulation system. As shown in FIG. 1 through FIG. 3, an ink circulation system 1 includes: an ink-jet head 2, an ink tank 3, a supply flowing route 4, a reflux flowing route 5, a damper 6, and a differential pressure generating unit 7.

The ink-jet head 2 is a component for discharging ink drops. Therefore, a lot of nozzles 11 and a shared ink flowing route 12, connected to all the nozzles 11, are shaped in the ink-jet head 2.

The shared ink flowing route 12 is a flowing path through which ink supplied from the ink tank 3 to the ink-jet head 2 flows. The shared ink flowing route 12 is connected to all the nozzles 11 shaped in the ink-jet head 2. In other words, the shared ink flowing route 12 is a component for distributing each of the nozzles 11 with the ink supplied from the ink tank 3 to the ink-jet head 2. Incidentally, there is shaped only one set of the shared ink flowing route 12 in one set of the ink-jet head 2. Then, an inlet 12*a* for introducing the ink supplied from the ink tank 3 into the shared ink flowing route 12 is shaped at one end of the shared ink flowing route 12, and on the other hand, an outlet 12*b* for discharging the ink supplied into the shared ink flowing route 12 and refluxing the ink to the ink tank 3 is shaped at the other end of the shared ink flowing route 12. Thus, the inlet 12*a* and the outlet 12*b* are shaped at both the ends of the shared ink flowing route 12. Therefore, the ink introduced through the inlet 12*a* flows from one end of the shared ink flowing route 12 to the other end of the same, and then gets discharged through the outlet 12*b*.

Each of the nozzles 11 discharges the ink supplied from the shared ink flowing route 12, as a certain amount of ink drops. Each of the nozzles 11 is so shaped as to be fine tubular. Furthermore, in each of the nozzles 11, shaped is a chamber 11*a* being partially swelled in its diameter. The chamber 11*a* is equipped with a piezoelectric element, not shown in the drawing, for pressurizing the inside of the chamber 11*a*. When the piezoelectric element is driven in order to pressurize the inside of the chamber 11*a*, a certain amount of ink is ejected out of the chamber 11*a* so that an ink drop with a certain size is discharged from a tip of each of the nozzles 11. Incidentally, for implementation of optimizing a form and a flying course of an ink drop discharged from each of the nozzles 11, the ink supplied to each of the nozzles 11 is made into a form having a predetermined meniscus by means of adjusting a hydraulic head value of the ink-jet head 2 in relation to the ink tank 3, a negative pressure control of the ink tank 3, and so on.

The ink-jet head 2 structured in this way is mounted on a carriage, not shown in the drawing, which is so installed as to be movable in a scanning direction. Then, by discharging ink drops while traveling in a scanning direction of the carriage, the ink-jet head 2 prints an image and the like on a recording medium placed on a platen, which is not shown in the drawing. Incidentally, operation of printing an image and the like on a recording medium by the ink-jet head 2 discharging ink drops while traveling in a scanning direction is called 'scanning.'

The ink tank 3 is a tank that stores ink to be supplied to the ink-jet head 2. The ink tank 3 is shaped to be almost cylindrical, and it is placed at an elevation so as to have a predetermined hydraulic head value in relation to the ink-jet head 2. Furthermore, a negative pressure control unit such as a pump, not shown in the drawing, is connected to the ink tank 3. Then, corresponding to the hydraulic head value brought in between the ink-jet head 2 and the ink tank 3, the negative pressure control unit controls the negative pressure inside the ink tank 3 so as to form the ink, supplied to each nozzle of the ink-jet head 2, into a predetermined shape of meniscus.

The ink tank 3 is provided with a partition plate 13 for partitioning an internal area of the ink tank 3 into an upper area 'A' and a lower area 'B.'

The partition plate 13 is so shaped as to be a thin disc closely-attached to an internal wall of the ink tank 3. Then, in the partition plate 13, there are shaped a center opening 13*a* that passes through a center portion, and a plurality of surrounding openings 13*b* that pass through a surrounding portion.

The center opening 13*a* is a circular opening shaped at the center portion of the partition plate 13. An opening diameter of the center opening 13*a* is greater in its size than that of the surrounding openings 13*b*, and the ink stored in the ink tank 3 can freely move up and down between the upper area and the lower area of the ink tank 3, partitioned with the partition plate 13, by way of the center opening 13*a*.

The surrounding openings 13*b* are circular openings shaped in a surrounding portion of the partition plate 13, on a circumference of a circle with a predetermined radius, being distant from a center of the partition plate 13. An opening diameter of each of the surrounding openings 13*b* is smaller in its size than that of the center opening 13*a*, and the ink stored in the ink tank 3 can gently move up and down between the upper area and the lower area of the ink tank 3, partitioned with the partition plate 13, by way of the surrounding openings 13*b*.

The supply flowing route 4 is a flowing path, connected to the ink tank 3 and the ink-jet head 2, for supplying the ink from the ink tank 3 to the ink-jet head 2. The supply flowing route 4 is constructed by using a long and thin tubular material (pipe).

One end of the supply flowing route 4 is connected to a bottom section of the ink tank 3, and a supply port 4*a* at its top end is opened to the inside of the ink tank 3. Thus, the ink tank 3 and the supply flowing route 4 are connected each other. Then, the ink stored in the ink tank 3 is supplied to the supply flowing route 4 via the supply port 4*a*. Incidentally, the end of the supply flowing route 4 may pass through a wall of the ink tank 3 so as to protrude into the inside of the ink tank 3. In such a case, it is preferable that the supply port 4*a* is located in the vicinity of an internal wall of the ink tank 3 or at a lower portion of the same.

The other end of the supply flowing route 4 is connected to the ink-jet head 2, and a top of the other end is connected to the inlet 12*a* of the shared ink flowing route 12. Thus, the supply flowing route 4 and the shared ink flowing route 12 are connected each other. Then, the ink flowing through the supply flowing route 4 is supplied to the shared ink flowing route 12 via the inlet 12*a*.

Furthermore, the supply port 4*a* is equipped with a trap filter 14 for removing impurities, such as clotted ink, foreign particles, and the like. In other words, the ink tank 3 and the supply flowing route 4 are connected each other by way of the trap filter 14. Therefore, the supply flowing route 4 is supplied with the ink coming out of the ink tank 3, from which the impurities have been removed; and eventually the ink is supplied to the shared ink flowing route 12 of the ink-jet head 2.

The reflux flowing route 5 is a flowing path, connected to the ink-jet head 2 and the ink tank 3, for refluxing the ink from the ink-jet head 2 to the ink tank 3. The reflux flowing route 5 is constructed by using a long and thin tubular material (pipe).

One end of the reflux flowing route 5 is connected to the ink-jet head 2, and a top of the end is connected to the outlet 12*b* of the shared ink flowing route 12. Thus, the reflux flowing route 5 and the shared ink flowing route 12 are connected each other. Then, the ink flowing through the shared ink flowing route 12 is discharged into the reflux flowing route 5 via the outlet 12*b*.

Passing through a circumferential wall of the ink tank 3 in an upper section of the ink tank 3, the other end of the reflux flowing route 5 is connected to the ink tank 3. Then, the other end of the reflux flowing route 5 is extended around to a central axis of the ink tank 3, and a reflux port 5*a* at a tip of the other end is opened in the ink tank 3. Thus, the ink tank 3 and the reflux flowing route 5 are connected each other. Then, the ink flowing through the reflux flowing route 5 is discharged into the ink tank 3 via the reflux port 5*a*. Incidentally, the other end of the reflux flowing route 5 may not be protruded around to the central axis of the ink tank 3. In such a case, it is preferable that the reflux port 5*a* is located at a position that is upper than, or closer to the central axis than the supply port 4*a* of the supply flowing route 4.

The damper 6 mitigates a fluctuation of the ink pressure generated due to scanning operation. In the course of scanning operation, an inertia force acts on the ink inside the ink-jet head 2, in keeping with traveling of the carriage; and therefore a fluctuation of the ink pressure is generated inside the ink-jet head 2 at the time of changing the traveling speed as well as the traveling direction of the carriage, and so on. Then, the fluctuation of the ink pressure inside the ink-jet head 2 is mitigated by the damper 6 so as to stabilize a form property and a flying course of an ink drop discharged from the ink-jet head 2. The damper 6 is placed in the supply flowing route 4 as well as the reflux flowing route 5 for mitigating the fluctuation of the ink pressure at an ink entrance and an ink exit with respect to the ink-jet head 2.

The differential pressure generating unit 7 generates a differential pressure of the ink stored in the ink tank 3 in order to circulate the ink inside the ink flowing route by way of the ink tank 3, the supply flowing route 4, the shared ink flowing route 12 of the ink-jet head 2, and the reflux flowing route 5. Incidentally, by the differential pressure generating unit 7, the ink circulates through the ink flowing route that also includes other units existing in the ink flowing route, such as the damper 6, and so on. Explanation about those other units is omitted for the convenience of explanation.

The differential pressure generating unit 7 includes an impeller 21 (a bladed wheel), positioned inside the ink tank 3 and under the partition plate 13, and a drive unit 22 placed outside the ink tank 3.

Figure 4A:
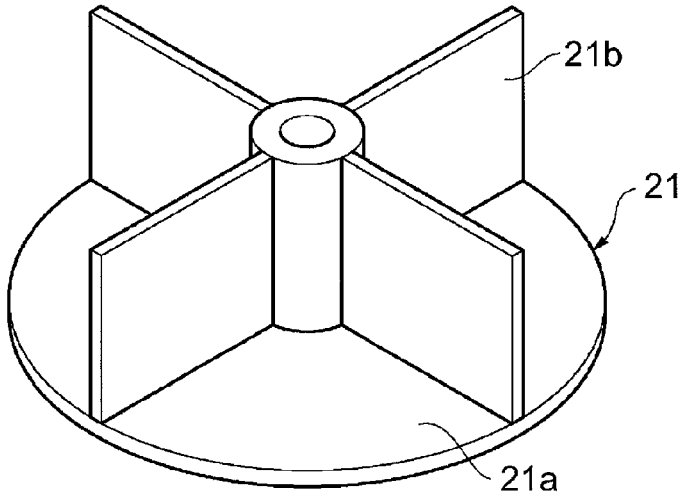
FIGS. 4A and 4B are perspective views of impellers.
Figure 4B:
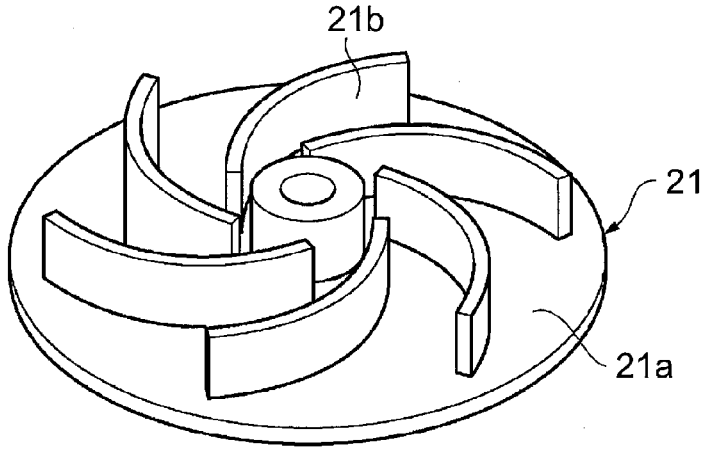

FIGS. 4A and 4B are perspective views of impellers; and FIG. 4A shows an impeller equipped with flat-plate blades, while FIG. 4B shows an impeller equipped with curved blades. As shown in FIGS. 4A and 4B, the impeller 21 is composed of a turning disc 21*a* and a blade portion 21*b*.

Having a coupling magnet (a magnet) assembled, the turning disc 21*a* is a disc-shaped member to be turned by the drive unit 22. The turning disc 21*a* is positioned in the vicinity of a bottom of the ink tank 3 so as to be in parallel with the bottom of the ink tank 3.

The blade portion 21*b* turns the ink stored in the ink tank 3 in accordance with turning operation of the turning disc 21*a*. The blade portion 21*b* is vertically installed on a top face of the turning disc 21*a*. The blade portion 21*b* may be shaped in any form as far as it is able to turn the ink stored in the ink tank 3. For example, the blade portion 21*b* may be a plurality of flat blades arranged in a radial manner, as shown in FIG. 4A; or it may be a plurality of curved blades arranged in a radial manner, as shown in FIG. 4B. Each blade of the blade portion 21*b* is placed in a radial manner from a turning axis of the turning disc 21*a* so as to turn the ink around the turning axis of the turning disc 21*a*.

The drive unit 22 is composed of a drive motor 22*a* for rotary driving and a turning disc 22*b* to be turned by the drive motor 22*a*.

The drive motor 22*a* is a drive source for turning the turning disc 22*b*. Receiving electric power supplied out of a power source, not shown in the drawing, the drive motor 22*a* turns a drive shaft. A drive shaft of the drive motor 22*a* is placed in a direction that extends in an axis direction of the ink tank 3. Then, the turning disc 22*b* is connected at a tip of the drive shaft of the drive motor 22*a*.

Having a coupling magnet (a magnet) assembled, the turning disc 22*b* turns the turning disc 21*a* of the impeller 21. Therefore, being connected to the drive shaft of the drive motor 22*a*, the turning disc 22*b* is placed in the vicinity of the bottom of the ink tank 3 so as to be in parallel with the bottom of the ink tank 3.

In the ink circulation system 1 structured as described above, when the drive motor 22*a* of the differential pressure generating unit 7 turns the turning disc 22*b*, turning motion of the turning disc 22*b* is transmitted to the turning disc 21*a* to turn the impeller 21 placed in the ink tank 3. Then, by turning motion of the impeller 21, the ink in the ink tank 3 is agitated. Furthermore, being expelled outward in a radial direction by the blade portion 21*b*, the ink in the ink tank 3 turns around the turning axis of the impeller 21. Therefore, since a centrifugal force acts according to the turning operation of the ink, the ink in the ink tank 3 is expelled further outward in the radial direction. As a result, a pressure distribution inside the ink tank 3 changes so that a differential pressure is generated in the tank 3.

Figure 5A:
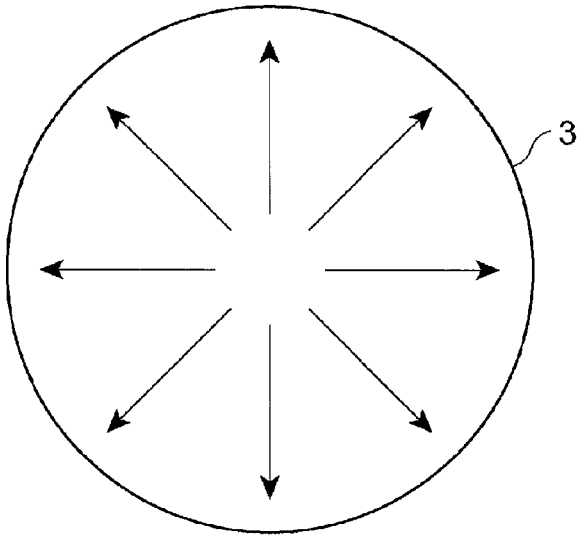
FIGS. 5A and 5B are views for explaining pressure condition inside the ink tank.
Figure 5B:
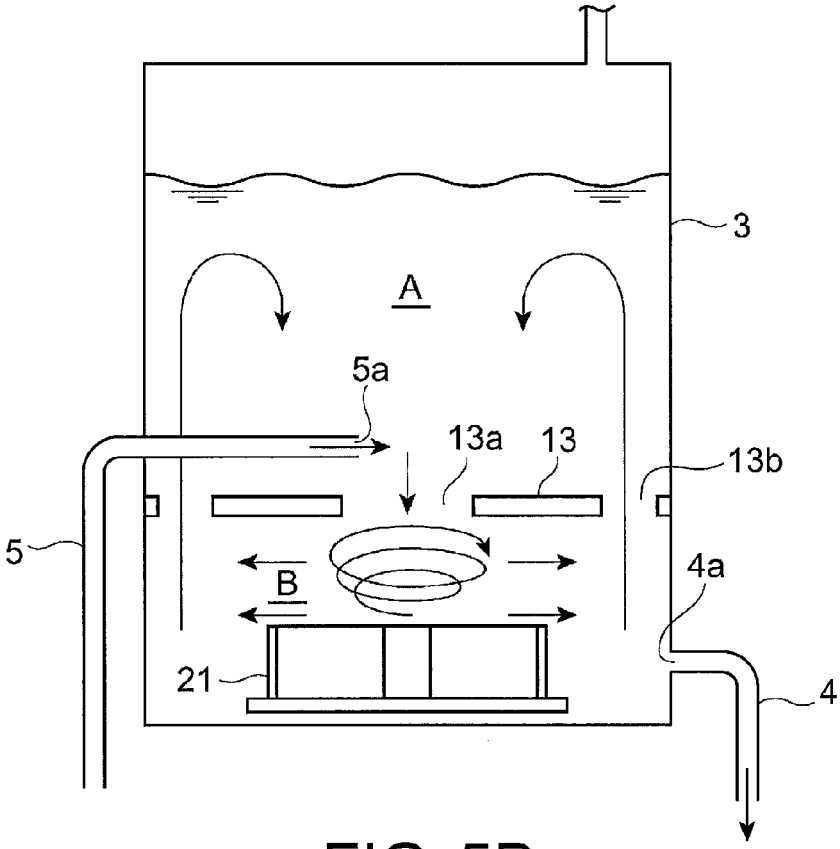

FIGS. 5A and 5B are views for explaining pressure condition inside the ink tank; and FIG. 5A shows a top view of the ink tank, while FIG. 5B shows a front elevation view of the ink tank. As shown in FIGS. 5A and 5B, when the impeller 21 turns, the ink in the ink tank 3 is expelled outward in the radial direction by the centrifugal force owing to the turning motion. Therefore, the further outward a location is in the radial direction, the higher the pressure is at the location. Contrarily, the nearer inward a location is in the radial direction, the lower the pressure is at the location. Then, the ink expelled outward in the radial direction by the turning impeller 21 is released upward through the surrounding openings 13*b* of the partition plate 13. Therefore, in the vicinity of the internal wall of the ink tank 3, the higher a location is in a vertical direction, the lower the pressure is at the location; and contrarily, the lower a location is in the vertical direction, the higher the pressure is at the location. Then, the ink released upward through the surrounding openings 13*b* flows toward a center area of the tank 3 where the pressure is lower. Being pulled downward through the center opening 13*a* of the partition plate 13 into the lower area of the tank 3, which is partitioned with the partition plate 13, the ink is expelled again outward in the radial direction by the turning motion of the impeller 21.

Incidentally, the surrounding openings 13*b* of the partition plate 13 have a smaller diameter, and therefore the volume of the ink entering the upper area 'A' from the lower area 'B' through the surrounding openings 13*b* is small; and meanwhile a turning force of the ink generated by the turning motion of the impeller 21 is transmitted to the upper area 'A' after being remarkably reduced. As a result, the centrifugal force associated with the turning motion of the ink is small in the upper area 'A' so that a level difference in the ink liquid surface does not become significant.

Under such a situation, the supply port 4*a* of the supply flowing route 4 has a positive pressure, namely a high pressure, in comparison with the static pressure; and in the meantime, the reflux port 5*a* of the reflux flowing route 5 has a negative pressure, namely a low pressure, in comparison with the static pressure. Therefore, a predetermined differential pressure is generated between the supply port 4*a* and the reflux port 5*a*. As a result, owing to the differential pressure, the ink inside the ink tank 3 is expelled into the supply flowing route 4 through the supply port 4*a;* and meanwhile, the ink flowing through the reflux flowing route 5 is sucked into the ink tank 3 via the reflux port 5*a*. Then, the ink expelled out of the ink tank 3 into the supply flowing route 4 through the supply port 4*a* is introduced into the shared ink flowing route 12 via the inlet 12*a*. Subsequently, after flowing through the shared ink flowing route 12, the ink is discharged into the reflux flowing route 5 via the outlet 12*b* so as to be sucked into the ink tank 3 via the reflux port 5*a*. Thus, the ink circulates through the ink flowing route by way of the ink tank 3, the supply flowing route 4, the shared ink flowing route 12, and the reflux flowing route 5. Incidentally, through the supply port 4*a*, the ink from which the impurities have been removed by using the trap filter 14 is expelled into the supply flowing route 4.

Explained next is the differential pressure between the supply port 4*a* and the reflux port 5*a*, generated by the differential pressure generating unit 7.

The differential pressure generating unit 7 generates a differential pressure for dispersing fine particles contained in a solvent of the ink by circulating the ink through the ink flowing route. Therefore, the differential pressure generated by the differential pressure generating unit 7 needs to have a value of the differential pressure with which the ink circulates in such a way as to disperse the fine particles.

As described above, the negative pressure inside the ink tank 3 is controlled so as to form a predetermined shape of meniscus by using each of the nozzles 11 of the ink-jet head 2. Therefore, it is preferable that the differential pressure generated by the differential pressure generating unit 7 has a value of the differential pressure within a range for meniscus form maintaining performance.

In the meantime, various pressure losses happen to the ink flowing through the ink flowing route. Therefore, at the time of setting a differential pressure to be generated by the differential pressure generating unit 7, it is also necessary to take these pressure losses into consideration.

Figure 6:
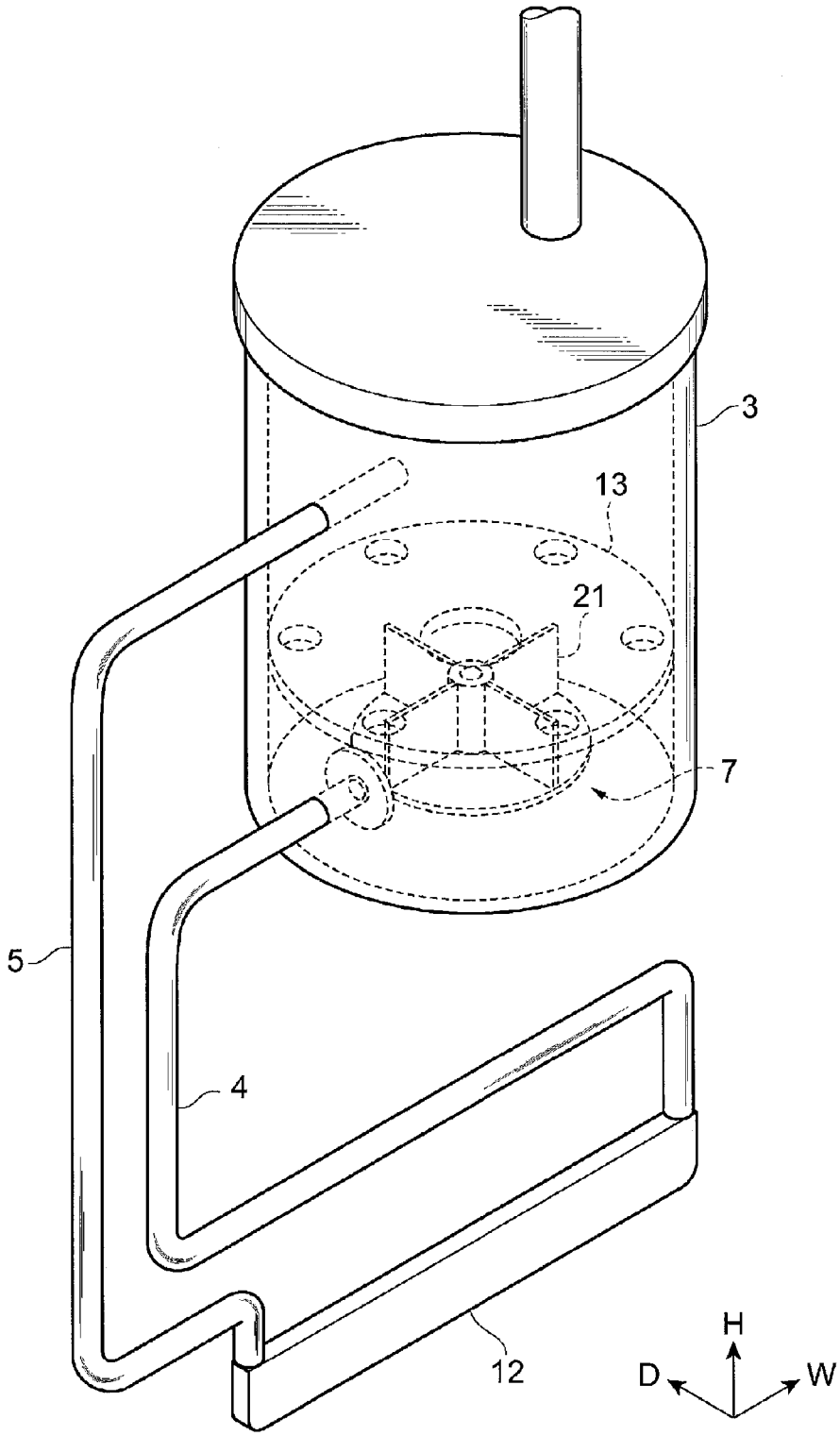
FIG. 6 is a perspective view showing an example of an ink flowing route in the ink circulation system.

FIG. 6 is a perspective view showing an example of an ink flowing route in the ink circulation system. In FIG. 6, forms of the supply flowing route 4 and the reflux flowing route 5 are changed as a matter of convenience. Inner dimensions of the shared ink flowing route 12 of the ink-jet head 2 are smaller than an inner diameter of the tubular members of the supply flowing route 4 and the reflux flowing route 5. Dimensions in the case of FIG. 6 are exemplified as described below; namely, the supply flowing route 4 and the reflux flowing route 5 have their inner diameter of 3 mm and their length of 200 mm, and meanwhile the shared ink flowing route 12 has a width (W) of 36 mm, a height (H) of 3.5 mm, and a depth (D) of 0.3 mm. Incidentally, 'W', 'H', and 'D' above represent the dimensions in the directions of the corresponding arrows of 'W', 'H', and 'D' shown in the drawing. Thus, when the ink is supplied from the supply flowing route 4 into the shared ink flowing route 12, a pressure loss happens; and furthermore, another pressure loss also happens when the ink flows through the shared ink flowing route 12. Moreover, the higher the viscosity of the ink is, the greater pressure losses the ink has when flowing through the ink flowing route to cause the pressure losses. Therefore, it is preferable to set a value of the differential pressure to be generated by the differential pressure generating unit 7 in such a way that the differential pressure generating unit 7 circulates the ink through the ink flowing route while acting against those pressure losses for dispersing the fine particles.

The differential pressure to be generated by the differential pressure generating unit 7 can variably be controlled in such a way as to have an optimum value arbitrarily by changing the RPM of the impeller 21 as well as changing a form of the blade portion 21*b* of the impeller 21.

Figure 7:
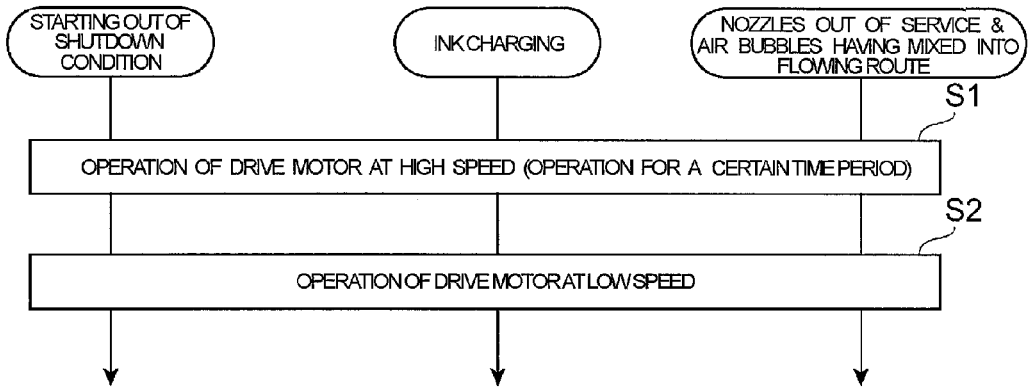
FIG. 7 is a sequence diagram that shows handling operation of the ink circulation system.

Explained next is a method of controlling the ink circulation by using the ink circulation system 1 with reference to FIG. 7. FIG. 7 is a sequence diagram that shows handling operation of the ink circulation system.

As shown in FIG. 7, at the time of staring the ink-jet printer under shutdown condition, the drive motor 22*a* gets driven to turn the drive shaft at high speed (Step S1). Then, the impeller 21 in the ink tank 3 turns at high speed so as to agitate the ink inside the ink tank 3 swiftly and expel the ink outward in the radial direction. As a result, a great differential pressure is generated between the supply port 4*a* and the reflux port 5*a* in the ink tank 3. Under the situation, when the impeller 21 turns at high speed, for example, approximately at 2000 rpm by operation of the drive motor 22*a*, there is generated a differential pressure of e.g., about 100 to 200 Pa between the supply port 4a and the reflux port 5*a*. Accordingly, the ink is swiftly agitated in the ink tank 3 to disperse the fine particles contained in the solvent of the ink. Furthermore, the ink of the ink tank 3 swiftly circulates through the ink flowing route by way of the ink tank 3, the supply flowing route 4, the shared ink flowing route 12, and the reflux flowing route 5 so as to disperse the fine particles contained in the solvent of the ink.

Subsequently, after operating the drive motor 22*a* for a certain time period under the condition, the quantity of operation of the drive motor 22*a* is reduced to turn the drive shaft of the drive motor 22*a* at low speed (Step S2).

Then, as the impeller 21 in the ink tank 3 turns at low speed, the ink inside the ink tank 3 is agitated more gently than in Step S1 to be expelled outward in the radial direction. As a result, a less differential pressure, than in Step S2, is generated between the supply port 4*a* and the reflux port 5*a* in the ink tank 3. Under the situation, when the impeller 21 turns at low speed, for example, approximately at 100 rpm by operation of the drive motor 22*a*, there is generated a differential pressure of e.g., about 100 to 200 Pa between the supply port 4*a* and the reflux port 5*a*. Accordingly, the ink is gently agitated in the ink tank 3 to disperse the fine particles contained in the solvent of the ink. Furthermore, while keeping the ink of the ink tank 3 gently circulating through the ink flowing route by way of the ink tank 3, the supply flowing route 4, the shared ink flowing route 12, and the reflux flowing route 5 so as to disperse the fine particles contained in the solvent of the ink, the ink-jet printer can be operated.

Also, at the time of charging the ink-jet head 2 with ink, the drive motor 22*a* gets driven at first to turn the drive shaft at high speed (Step S1) in the same manner as described above. Accordingly, the ink of the ink tank 3 swiftly circulates through the ink flowing route by way of the ink tank 3, the supply flowing route 4, the shared ink flowing route 12, and the reflux flowing route 5; and then the ink is distributed to each of the nozzles 11 through the shared ink flowing route 12 of the ink-jet head 2, and at the same time, air bubbles mixed in the flowing route are also exhausted. Subsequently, after operating the drive motor 22*a* for a certain time period under the condition, the quantity of operation of the drive motor 22*a* is reduced to turn the drive shaft of the drive motor 22*a* at low speed (Step S2). In this way, while dispersing the fine particles contained in the solvent of the ink, the ink-jet printer can be operated.

Moreover, when any of the nozzles 11 are clogged with ink and so on to cause a problem of so-called "Nozzles out of service", or any air bubbles have mixed into the ink flowing route, the drive motor 22*a* gets driven at first to turn the drive shaft at high speed (Step S1) in the same manner as described above. Accordingly, the ink of the ink tank 3 swiftly circulates through the ink flowing route by way of the ink tank 3, the supply flowing route 4, the shared ink flowing route 12, and the reflux flowing route 5; and then the ink clogging the nozzles 11 and so on is expelled, and the air bubbles mixed into the ink flowing route are exhausted (purged). Subsequently, after operating the drive motor 22*a* for a certain time period under the condition, the quantity of operation of the drive motor 22*a* is reduced to turn the drive shaft of the drive motor 22*a* at low speed (Step S2). In this way, while dispersing the fine particles contained in the solvent of the ink, the ink-jet printer can be operated.

As described above, according to the ink circulation system 1 of the present invention, the ink is supplied to the inlet 12*a* of the shared ink flowing route 12 in the ink-jet head 2 from the ink tank 3 by way of the supply flowing route 4, and meanwhile the ink is refluxed to the ink tank 3 from the outlet 12*b* of the shared ink flowing route 12 by way of the reflux flowing route 5. Thus, the ink supplied from the ink tank 3 to the ink-jet head 2 is able to circulate through the ink flowing route by way of the ink tank 3, the supply flowing route 4, the shared ink flowing route 12, and the reflux flowing route 5. Then, generating the differential pressure between the supply port 4*a* and the reflux port 5*a* by using the differential pressure generating unit 7 makes it possible to circulate the ink through the ink flowing route by way of the ink tank 3, the supply flowing route 4, the shared ink flowing route 12, and the reflux flowing route 5. Thus, even when ink containing fine particles is used, the fine particles can be dispersed by means of generating the differential pressure in the ink tank 3 with the differential pressure generating unit 7, and therefore it becomes possible to control precipitation and deposition of the fine particles without adopting any complicated framework, such as installing an extra pump separately, and so on. Moreover, circulating the ink through the shared ink flowing route 12 as well makes it possible to control precipitation and deposition of the fine particles in the shared ink flowing route 12; and therefore simply exhausting only the ink that dwells in each of the nozzles of the ink-jet head 2 makes it possible to control unevenness of the fine particles in the ink flowing route, at the time of operating the ink-jet printer. As a result, the amount of ink exhausted wastefully by way of flashing can be cut back so that running costs of the ink-jet printer can significantly be reduced.

With the impeller 21 being placed in the ink tank 3, differential pressures can be generated between the vicinity of the central axis and the vicinity of the internal wall in the ink tank 3, and also between the upper area and the lower area in the tank 3, by means of turning the impeller 21 with the drive unit 22. Therefore, with the supply port 4*a* being placed in the vicinity of the internal wall in the lower area 'B' of the ink tank 3, and the reflux port 5*a* being placed in the vicinity of the central axis in the upper area 'A' of the ink tank 3, a differential pressure can easily be generated between the supply port 4*a* and the reflux port 5*a*. Moreover, as the impeller 21 turns in the ink tank 3, the ink stored in the ink tank 3 is also agitated so that the fine particles can be dispersed more appropriately.

Moreover, by means of providing the ink tank 3 with the partition plate 13, the ink tank 3 is partitioned into the upper area 'A' and the lower area 'B,' wherein the upper area 'A' and the lower area 'B' are connected each other by way of the center opening 13*a* and the surrounding openings 13*b*. Then, turning operation of the impeller 21 turns the ink in the lower area 'B,' and in the meantime the turning force of the ink in the lower area 'B' is transmitted to the upper area 'A' while the turning force being reduced by the partition plate 13. Therefore, even if the impeller 21 turns at high speed, the level of liquid in the vicinity of the central axis in the ink tank 3 can be kept away from becoming extremely low so as to make the reflux port 5*a* and/or the impeller 21 exposed out of the ink. Accordingly, ink dropping from the reflux port 5*a* and generating air bubbles by turning operation of the impeller 21 can be controlled to prevent the air bubbles from getting mixed into the ink.

In this case, by means of providing the ink tank 3 with the center opening 13*a* and the surrounding openings 13*b*, the ink can be circulated not only in the lower area 'B' where the impeller 21 is placed, but also in the upper area 'A.' Therefore, the fine particles can be dispersed in the entire area of the ink tank 3.

Then, in operation of the ink circulation system 1, the fine particles can efficiently be dispersed by means of turning the impeller 21 at first at high speed and afterward at low speed, to control precipitation and deposition of the fine particles. Therefore, because of cutting back electricity use, running costs can be reduced.

Explained above is the preferred embodiment of the present invention. Incidentally, the present invention is not limited to the embodiment described above. For example, though it is explained in the above embodiment that the differential pressure generating unit 7 including the impeller 21 and the drive unit 22 is adopted as an example of a differential pressure generating section, alternatively anything else may be adopted as far as it can generate a predetermined differential pressure between the supply port 4*a* and the reflux port 5*a* in the ink tank 3.

In the above embodiment, it is explained that the supply port 4*a* is placed in the vicinity of the internal wall in the lower area 'B' of the ink tank 3, and the reflux port 5*a* is placed in the vicinity of the central axis in the upper area 'A' of the ink tank 3. Alternatively, any other layout may be applied as far as the differential pressure is generated in the ink tank 3. For example, both the ports may be placed in the lower area 'B', and they may still be placed in the vicinity of the internal wall of the ink tank 3.

In the above embodiment, it is explained that the partition plate 13 is provided for the ink tank 3. Alternatively, the partition plate 13 may not be provided if there happens only a differential pressure that brings almost no problematic change in the ink liquid surface.

In the above embodiment, an ink circulation system to be installed in an ink-jet printer is explained as an example of the present invention. Alternatively, the present invention may be applied to a liquid circulation system to be installed in a liquid discharging unit for an industrial use and the like, which discharges high-viscosity liquid, such as edible oil, adhesive, and so on. When being applied to such a liquid circulation system, the present invention enables the high-viscosity liquid to keep on moving without interruption. Therefore, such an industrial-use liquid coating machine can shift into actual operating condition quickly after starting operation.

What is claimed is:

1. A liquid circulation system to be installed in a liquid discharging machine for discharging liquid, comprising:

a liquid discharge head having a plurality of nozzles for discharging liquid and a shared flowing route connected to the nozzles;

a liquid container for storing the liquid to be supplied to the liquid discharge head;

a first flowing route for supplying the liquid from the liquid container to one end of the shared flowing route;

a second flowing route for refluxing the liquid from the other end of the shared flowing route to the liquid container; and a differential pressure generating section for generating a differential pressure between a supply port, through which the liquid is supplied from the liquid container to the first flowing route, and a reflux port, through which the liquid is refluxed from the second flowing route to the liquid container, in the liquid stored in the liquid container, the differential pressure generating section includes an impeller, the liquid container is provided with a partition plate for partitioning the liquid container into two areas, the partition plate includes a center opening and a plurality of surrounding openings, the reflux port is placed in one area, and the supply port and the impeller are placed in the other area.

2. The liquid circulation system according to claim 1, wherein the differential pressure generating section further includes:

a rotary driving section for turning the impeller.

* * * * *